US006533165B2

(12) United States Patent
Giblin et al.

(10) Patent No.: US 6,533,165 B2
(45) Date of Patent: Mar. 18, 2003

(54) CARTON

(75) Inventors: Edward John Giblin, Hopatcong, NJ (US); Corinne Saso, Ridgefield Park, NJ (US); Jeannine Desmond Griffiths, Kinnelon, NJ (US); Richard Chalmers, Crystal Lake, MI (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/749,958

(22) Filed: Dec. 28, 2000

(65) Prior Publication Data

US 2002/0084318 A1 Jul. 4, 2002

(51) Int. Cl.[7] ..... B65D 5/02; B65D 5/42

(52) U.S. Cl. ..... 229/183; 206/521; 206/587; 206/591; 229/939

(58) Field of Search ..... 229/132, 134, 229/136, 183, 939; 206/396, 521, 540, 587, 591, 486, 592

(56) References Cited

U.S. PATENT DOCUMENTS 634,647 A * 10/1899 Knobeloch ..... 206/521
2,163,045 A * 6/1939 Lavere ..... 206/591
2,203,084 A 6/1940 Evans
3,159,274 A * 12/1964 Burt ..... 206/521
3,668,052 A 6/1972 Pratt
4,437,569 A * 3/1984 Sorenson ..... 229/132
4,437,570 A * 3/1984 Sorenson ..... 206/521
4,445,613 A * 5/1984 Cassidy ..... 206/486
4,511,037 A * 4/1985 Lucous ..... 206/486
4,976,676 A 12/1990 Mensing et al.
5,085,367 A 2/1992 Carstens
5,094,385 A 3/1992 Antezak et al.
5,325,602 A * 7/1994 Nainis et al. ..... 229/120
5,372,259 A * 12/1994 Suzuki et al. ..... 206/587
5,667,871 A 9/1997 Goodrich et al.
5,915,556 A 6/1999 Simpson
6,092,651 A 7/2000 Miller

FOREIGN PATENT DOCUMENTS

WO 99/50154 10/1999

* cited by examiner

*Primary Examiner*—Gary E. Elkins
(74) *Attorney, Agent, or Firm*—Gerard J. McGowan, Jr.

(57) ABSTRACT

Tablets and other relatively fragile consumer products can be transported in a carton with little or no compromise to their integrity by providing bottom flaps of the carton with slits for cushioning the carton. Preferably, at least two adjacent flaps include the slits. Instead of slits, perforated lines or non-linear lines can be used. However, in a preferred embodiment, the carton is a corrugated carton and the slits run parallel to the lines of corrugation. More preferably, the corrugation includes troughs and the slits are imposed in the fiberboard parallel to and opposite the troughs of the corrugations.

7 Claims, 2 Drawing Sheets

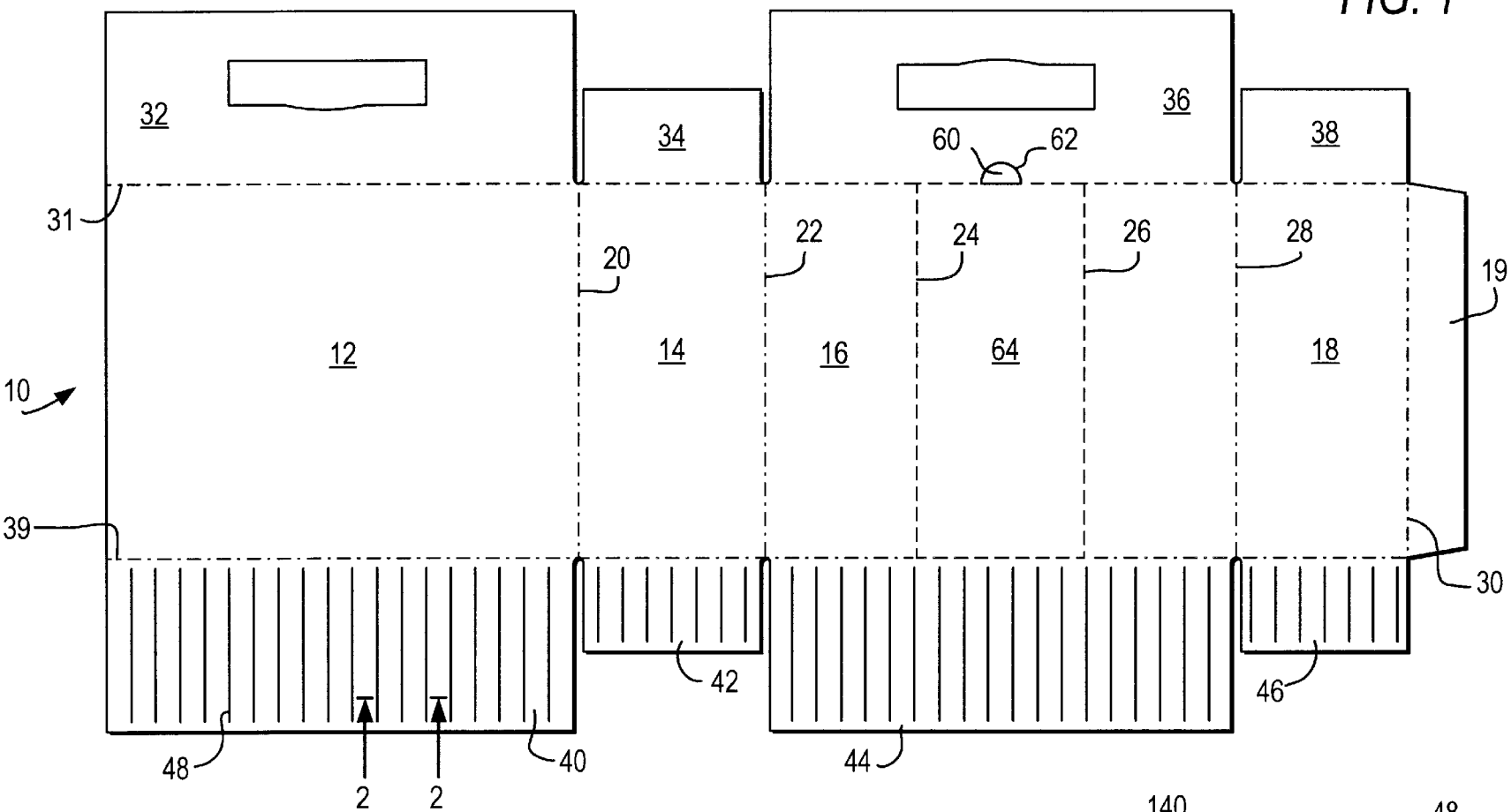
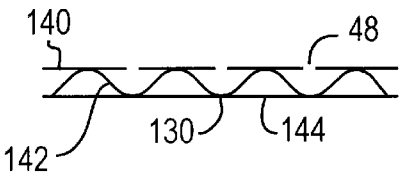
FIG. 2

CARTON

BACKGROUND OF THE INVENTION

In an effort to provide consumers with the best form of laundry products to meet their needs, manufacturers have developed new product forms and have even brought back old product forms. One product form which has recently been launched is the laundry detergent tablet. However, with tablets it is desirable to minimize any full or partial disintegration during shipping and storage.

Various patents have been directed to inventions wherein package materials are processed so as to impart certain desired characteristics.

Carstens, U.S. Pat No. 5,085,367 discloses that to increase the compressive strength of a corrugated cardboard box, the horizontal edges of the box are perforated and the vertical edges are chemically treated.

Pratt, U.S. Pat. No. 3,668,052 discloses a corrugated arcuate member having a plurality of rigid corrugations and having improved formability as a result of a plurality of generally transverse slots disposed along a radially outer portion of the corrugation.

Simpson, U.S. Pat. No. 5,915,556 discloses a shock absorbing component for packaging an article. The component is foldable for enclosing the article therein. One section of the component includes multiple non-linear cuts or serrations such that upon placing the article between the first and a second section, the cuts allow the first section to deform and at least partially conform to the shape of the first surface of the article. The component may be disposed within, or integrally formed with, a shipping container having exterior protective walls.

Goodrich et al., U.S. Pat. No. 5,667,871 discloses a filling material for use in filling hollow spaces in packaging or the like and having a plurality of individual slits formed in parallel spaced rows extending transversely from one end of the paper material to the opposing end of the paper material. It is said that when the material of the invention, most preferably paper, is cut in a particular pattern and expanded it increases in length, decreases in width and increases dramatically in effective cushioning thickness.

Evans, U.S. Pat. No. 2,203,084 discloses a fiberboard structure for extending a panel or sheet of fiberboard, such as certain top and bottom panels, over an area greater than it normally occupies.

Mensing et al., U.S. Pat. No. 4,976,676 discloses an apparatus for slitting and/or grooving material sheets of corrugated board.

Miller, U.S. Pat. No. 6,092,651 discloses a wrap around hinged end cap for packaging a computer system. Straight cut slits are said to permit modification of impact absorption characteristics of various portions of the packaging device.

Other containers having various forms of scores or slits include that of Antczak et al., U.S. Pat. No. 5,094,385.

SUMMARY OF THE INVENTION

It has been discovered that tablets and other potentially breakable consumer products can be transported in a carton with little or no compromise to their integrity by providing bottom flaps of the carton with cuts for cushioning the carton. Preferably, at least two adjacent flaps include the cuts, preferably in the form of slits. The cuts can be in the form of long, uninterrupted slits, perforated lines or non-linear cuts. However, in a preferred embodiment, the carton is a corrugated carton and the slits run parallel to the lines of corrugation. More preferably, the corrugation includes troughs and the slits are imposed in the fiberboard parallel to and opposite the troughs of the corrugations.

Most preferably, all of the bottom flaps include slits or other cuts.

Preferably the slits or other cuts are regularly spaced across the bottom closure flaps averaging say one slit for every corrugation, one slit for every other corrugation, or one slit for every three corrugations. Preferably there is on average at least one slit or other cut for every three corrugations.

In accordance with another aspect of the invention, a carton blank is provided wherein the bottom flaps include the slits. Preferably the slits are transverse to the longitudinal axis of the carton blank.

For a more complete understanding of the above and other features and advantages of the invention, reference should be made to the following Detailed Description of the Preferred Embodiments and to the accompanying drawings.

BRIEF DESCRIPTION OF THE DRAWINGS

FIG. 1 is a top plan view of a carton blank according to the invention.

FIG. 2 is a cross section along the lines 2—2 of FIG. 1.

DETAILED DESCRIPTION OF THE INVENTION

Figure 3:
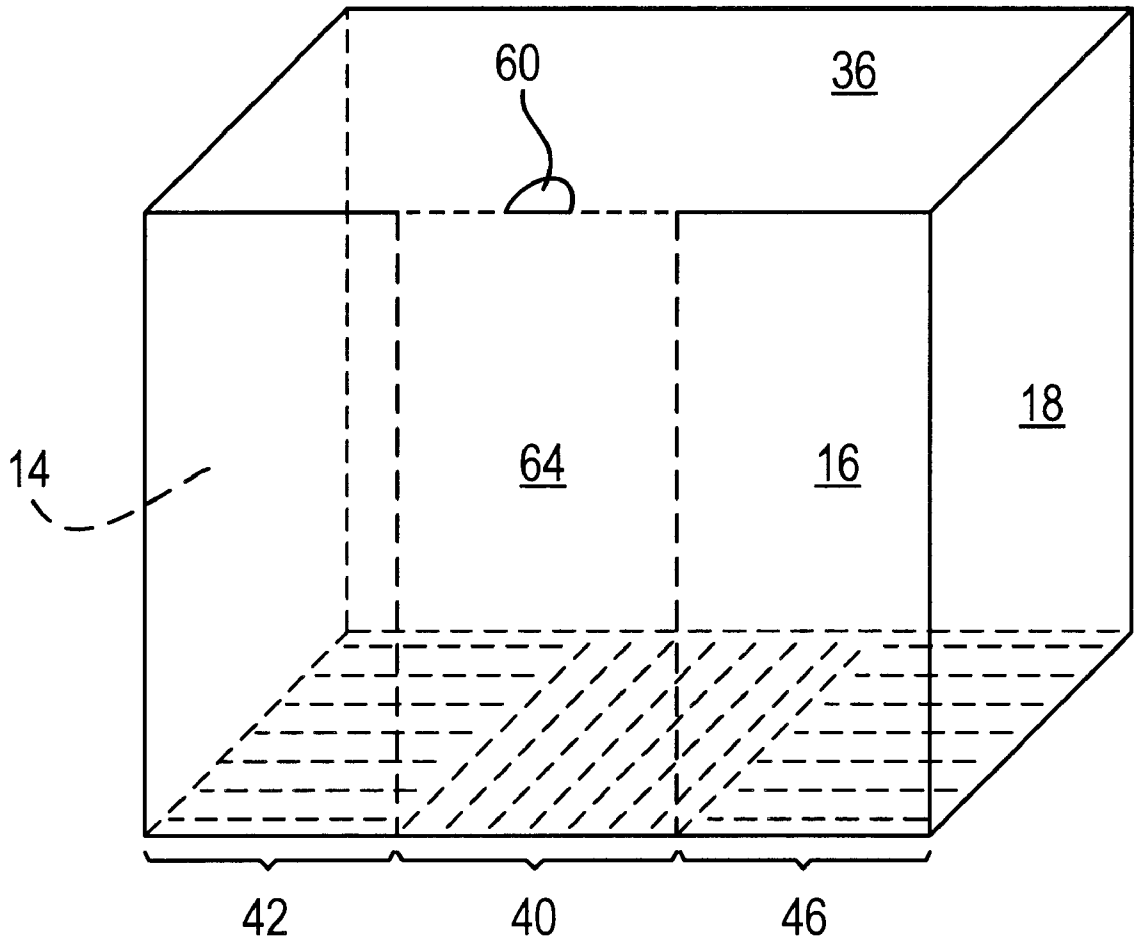
FIG. 3 is a perspective view of a carton according to the invention.

As seen in FIG. 1, carton blank 10 comprises rear panel 12, separated from side panel 14 by scoreline 20. Front panel 16 is separated from side panel 14 by scoreline 22. Side panel 18 is separated from front panel 16 by scoreline 28 and glue flap 19 is separated from side panel 18 by scoreline 30.

Front panel 16 includes two additional transverse scorelines 24 and 26 which define a dispensing opening for the carton.

Scoreline 30 traverses the tops of panels 12, 14, 16 and 18 and separates them from top flaps 32, 34, 36 and 38. Flaps 32 and 36 are major flaps whereas 34 and 38 are minor flaps.

Scoreline 39 traverses the bottoms of panels 12, 14, 16 and 18 and separates them from bottom flaps 40, 42, 44 and 46. The bottom flaps include transverse slits 48 in the top layer of the corrugated fiberboard. Preferably the slits or other cuts are imposed in the top layer only of the corrugated fiberboard, as illustrated. The corrugated fiberboard of FIG. 2 comprises an inner liner 140 (top layer in FIG. 2), a corrugated medium 142 and an outer liner 144 (bottom layer in FIG. 2). The corrugations preferably run transverse to the longitudinal axis of the blank and parallel to the slits. Indeed, as shown, in FIG. 2, the slits preferably are imposed in inner liner 140 opposite the troughs 130 of the corrugations, preferably opposite each trough of the corrugated medium 142. However, the slits may be imposed in some other pattern, such as in every other corrugation or every third corrugation. Or, the pattern may average every other or every third corrugation rather than actually being disposed exactly in every other or third trough. Preferably no slits or other cuts are imposed on outer liner 144. Top closure flaps may be free of slits or other cuts spaced throughout the flaps as illustrated and described (eg., every third corrugation), if so desired.

Notch 60 is defined by lines of weakness 62 in top flap 36 so that when it is desired to open the carton a consumer can grasp the notch and remove section 64 of front panel 16. This is particularly beneficial when the carton contains detergent tablets since the tablets will be of a size so that they can readily be removed through the opening created by removal of partial panel 64. Scorelines 24 and 26 roughly divide front panel 16 into thirds.

It will be appreciated that the presence of the slits will cushion the carton and therefore can be expected to result in decreased disintegration of the tablets, which may be somewhat more susceptible to break-up during transport than other forms of laundry product.

It will be appreciated that the presence of the corrugations running transverse to the longitudinal axis of the blank and therefore from the top to the bottom of the carton will be invaluable in maintaining the compression strength of the carton. At the same time, the slits in the bottom flaps will cushion the tablets or other products contained within the carton.

It should be understood of course that specific forms of the invention herein illustrated and described are intended to representative only as certain changes may be made therein without departing from the clear teachings of the disclosure. Accordingly reference should be made to the following appended claims in determining the full scope of the invention.

What is claimed is:

1. A carton comprising a front panel, a first side panel adjacent said front panel, a rear panel adjacent said first side panel and opposite said front panel and a second side panel adjacent said rear panel and opposite said first side panel, top closure flaps, and bottom closure flaps wherein at least two adjacent of said bottom closure flaps contain slits or other cuts for cushioning contents of said carton, wherein said carton bottom flaps are corrugated and said slits or other cuts are disposed parallel to the corrugations opposite troughs in the corrugations.

2. The carton according to claim 1 wherein said carton contains detergent tablets.

3. The carton according to claim 1 wherein all of said bottom flaps include said slits or other cuts.

4. The carton according to claim 1 wherein said slits or other cuts are regularly spaced across said bottom closure flaps.

5. The carton according to claim 1 wherein corrugations on said front and rear panels are disposed parallel to fold lines separating said panels.

6. A carton blank comprising a front panel, a rear panel, a first side panel between said front and rear panel and a second side panel adjacent one of said front and rear panels, said panels being separated from each other by fold lines, top closure flaps at one end of at least two of said panels and at least two adjacent bottom closure flaps at another end of said panels, said bottom flaps having slits or other cuts for cushioning contents of a carton erected from said blank, wherein the blank is made of corrugated fiberboard and wherein the corrugations extend transversely to a longitudinal axis of said blank, said slits or other cuts extending parallel to said corrugations.

7. The blank according to claim 6 wherein said corrugations include troughs and said slits or other cuts are formed opposite said troughs.

* * * * *